US010758949B2

(12) United States Patent
Vallois

(10) Patent No.: US 10,758,949 B2
(45) Date of Patent: Sep. 1, 2020

(54) PNEUMATIC WASHING AND DRYING MACHINE

(71) Applicant: RIDEL, Neufchatel-en-Bray (FR)

(72) Inventor: Matthieu Vallois, Tourville sur Arques (FR)

(73) Assignee: RIDEL, Neufchatel-en-Bray (FR)

( * ) Notice: Subject to any disclaimer, the term of this patent is extended or adjusted under 35 U.S.C. 154(b) by 141 days.

(21) Appl. No.: 15/685,431

(22) Filed: Aug. 24, 2017

(65) Prior Publication Data

US 2018/0056339 A1 Mar. 1, 2018

(30) Foreign Application Priority Data

Aug. 26, 2016 (FR) ..... 16 57988

(51) Int. Cl.

| | |
|---|---|
| ***B08B 3/02*** | (2006.01) |
| ***B08B 5/02*** | (2006.01) |
| ***B05B 15/555*** | (2018.01) |
| *B05B 15/80* | (2018.01) |

(Continued)

(52) U.S. Cl.

CPC ..... *B08B 3/024* (2013.01); *B05B 15/555* (2018.02); *B08B 3/02* (2013.01); *B08B 5/02* (2013.01); *B05B 15/80* (2018.02); *D06F 17/12* (2013.01); *D06F 58/203* (2013.01)

(58) Field of Classification Search

CPC ..... B05B 15/555; B05B 15/557; B05B 15/80; B08B 3/006; B08B 3/02; B08B 3/022; B08B 3/024; B08B 3/026; B08B 5/02; B08B 9/08; B08B 9/0804; B08B 9/0813; B08B 9/093; B08B 9/0936; B08B 9/20; B08B 9/28; B08B 2203/0252

See application file for complete search history.

(56) References Cited

U.S. PATENT DOCUMENTS 2,570,021 A * 10/1951 Beach ..... B08B 3/006 134/199
3,771,539 A 11/1973 De Santis
5,213,117 A 5/1993 Yamamoto (Continued)

FOREIGN PATENT DOCUMENTS

CN 1055680 A 10/1991
CN 201295684 Y 8/2009

(Continued)

OTHER PUBLICATIONS

FR Search Report, dated May 17, 2017, from corresponding FR application No. 1657988.

*Primary Examiner* — David G Cormier
(74) *Attorney, Agent, or Firm* — Nixon & Vanderhye

(57) ABSTRACT

A pneumatic washing and drying machine including a washing chamber and a liquid reservoir in fluid communication with the washing chamber, the washing chamber internally including spray nozzles directed towards at least a part to be washed arranged within the washing chamber and configured to spray a fluid so as to wash the at least one part and then air so as to dry the at least one part, the pneumatic washing and drying machine further includes a pneumatic unit powered by a compressed air supply to provide a liquid from the liquid reservoir to the spray nozzles via the air from the compressed air supply, and then provide air from the compressed air supply to the spray nozzles.

12 Claims, 5 Drawing Sheets

(51) Int. Cl.
*D06F 17/12* (2006.01)
*D06F 58/20* (2006.01)

(56) References Cited

U.S. PATENT DOCUMENTS

| | | | | |
|---|---|---|---|---|
| 5,707,457 | A * | 1/1998 | Yates | B08B 3/02 134/103.1 |
| 5,868,280 | A | 2/1999 | Schroeder | |
| 2010/0043841 | A1 | 2/2010 | Kaeske | |
| 2012/0241016 | A1 | 9/2012 | Kokot, Jr. et al. | |

FOREIGN PATENT DOCUMENTS

| | | | |
|---|---|---|---|
| CN | 101844315 | A | 9/2010 |
| DE | 10 2014 102 064 | A1 | 8/2015 |
| EP | 2 052 792 | A2 | 4/2009 |
| FR | 2 510 434 | A1 | 2/1983 |
| WO | 01/07178 | A1 | 2/2001 |
| WO | 2008/122383 | A1 | 10/2008 |
| WO | 2009/136448 | A1 | 11/2009 |

* cited by examiner

PNEUMATIC WASHING AND DRYING MACHINE

BACKGROUND OF THE INVENTION

Field of the Invention

The present invention relates to the field of washing and drying machines, and particularly relates to a pneumatic washing and drying machine.

Description of the Related Art

A conventional washing and drying machine generally comprises a washing chamber and a liquid reservoir in fluid communication with the washing chamber so as to collect the fluid from the washing chamber, a conventional water pump allowing to send the liquid contained into the liquid reservoir towards the washing chamber. However, the use of such a conventional water pump does not allow to operate at high liquid pressures and temperatures in the washing chamber.

US patent application US2010043841 A1 discloses a cleaning device for cleaning a part, in which a cleaning gas is introduced in a reservoir and a cleaning fluid subject to pressure is introduced in said reservoir, so as to pressurize the cleaning gas which is at an initial pressure, the cleaning liquid being brought to the reservoir from a vessel using a pump. However, this cleaning device does not allow to operate at high liquid pressures and temperatures in the washing chamber, and does not allow to wash and blow the part to be washed in a minimum time without using a conventional pump.

BRIEF SUMMARY OF THE INVENTION

The present invention is intended to solve the disadvantages of the prior art by providing a pneumatic washing and drying machine comprising pneumatic means powered with compressed air or compressed gas to bring a liquid from the liquid reservoir to the washing chamber via the compressed air or gas, and then to bring compressed air or gas to the washing chamber, thereby performing a washing and drying cycle in a minimum time, and operating at high liquid pressures and temperatures in the washing chamber.

The present invention thus relates to a pneumatic washing and drying machine comprising a washing chamber and a liquid reservoir in fluid communication with the washing chamber so as to collect the fluid from the washing chamber, said washing chamber being provided internally with spray nozzles configured to spray fluid within the washing chamber, the pneumatic washing and drying machine further comprising a compressed air supply, characterized in that the pneumatic washing and drying machine further comprises pneumatic means powered by the compressed air supply to bring the liquid from the liquid reservoir to the spray nozzles via the air from the compressed air supply, and then to bring the air from the compressed air supply to the spray nozzles, so as to perform at least one washing and drying cycle.

The spray nozzles can be directed towards at least a part to be washed, arranged within the washing chamber and configured, in a first phase, to spray liquid so as to wash the at least one part to be washed and then, in a second phase, spray air so as to dry the at least one part to be washed. The fluid sprayed by the spray nozzles can thus be water or air.

The liquid reservoir is preferably arranged below the washing chamber such that the liquid flows from the washing chamber to the liquid reservoir by gravity.

Thus, the pneumatic means allows a recirculation of the fluid contained into the liquid reservoir towards the washing chamber, so as to obtain washing fluid savings, the washing fluid being preferably water mixed with cleaning products such as detergents.

The pneumatic means powered by compressed air thus allows to wash the part to be washed using the liquid from the liquid reservoir, and then blow the part to be washed using the compressed air used to push the liquid towards the washing chamber, thereby allowing to perform a washing and drying cycle in a minimum time and operate at high liquid pressures and temperatures in the washing chamber.

It can be noted that the liquid reservoir is firstly filled with washing liquid before starting the pneumatic washing and drying machine, the washing liquid being optionally heated in advance using at least one resistor arranged within the liquid reservoir.

According to a first embodiment of the invention, the pneumatic means comprise at least one lower carboy arranged at the liquid reservoir, the at least one lower carboy comprising a liquid inlet connected to the liquid reservoir, a liquid outlet connected to the spray nozzles, an air inlet connected to the compressed air supply, and an air outlet connected to the spray nozzles, the pneumatic means further comprising lower carboy valves respectively connected to the inlets et outlets of the at least one lower carboy, and a control system configured to control said lower carboy valves so as to fill the at least one lower carboy with liquid from the liquid reservoir by gravity, inject compressed air into the at least one lower carboy so as to send, to the spray nozzles, the pressurized liquid contained into the at least one lower carboy, and then send the compressed air contained into the at least one lower carboy to the spray nozzles.

Thus, during a first filling phase, the lower carboy is filled with liquid from the liquid reservoir by communicating vessels and/or gravity and, during a second sprinkling phase, the liquid contained in the lower carboy is pushed towards the spray nozzles by the compressed air injected into the lower carboy and, during a third depressurization and blowing phase, the compressed air intended to push the liquid is sent towards the spray nozzles, thereby allowing to return the lower carboy at atmospheric pressure and also blow the part to be washed arranged within the washing chamber.

This solution thus allows to operate at higher pressures and temperatures compared to a case where a conventional pump is used.

Each carboy optionally has at least one liquid level sensor and one fluid pressure sensor.

According to a particular feature of the invention, the pneumatic means comprise at least two lower carboys arranged in parallel, the control system being configured to control the lower carboy valves of the at least two lower carboys in parallel such that the at least two lower carboys each successively perform their washing and drying cycle.

Thus, this solution allows to multiply the spraying phases without waiting, the filling of the lower carboys being performed in masking times when another lower carboy sends liquid towards the washing chamber in order to spray the part to be washed.

According to a particular feature of the invention, the pneumatic washing and drying machine further comprises an additional compressed air supply connected to the spray nozzles via an additional valve controlled by the control system.

Thus, this additional compressed air supply directly connected to the spray nozzles allows to perform a final blowing of the at least one part to be washed.

According to a second embodiment of the invention, the pneumatic means comprise at least one upper carboy arranged above the washing chamber, the at least one upper carboy comprising a liquid inlet, an air inlet connected to the compressed air supply, and a fluid outlet connected to the spray nozzles, the pneumatic means further comprising upper carboy valves respectively connected to the inlets and the outlet of the at least one upper carboy and a control system, the pneumatic means further comprising a liquid supply device connected to the liquid inlet of the at least one upper carboy and to the liquid reservoir, the control system being configured to control said upper carboy valves so as to fill the at least one upper carboy with liquid from the liquid supply device, inject compressed air into the at least one upper carboy so as to send, to the spray nozzles, the pressurized liquid contained into the at least one upper carboy, and then send the compressed air contained into the at least one upper carboy to the spray nozzles.

Thus, during a first filling phase, the upper carboy is filled with liquid from the liquid reservoir via the liquid supply device and, during a second sprinkling phase, the liquid contained into the upper carboy is pushed towards the spray nozzles by the compressed air injected into the upper carboy and, during a third depressurization and blowing phase, the compressed air intended to push the liquid is sent towards the spray nozzles, thereby allowing to return the upper carboy at atmospheric pressure and also to blow the part to be washed arranged within the washing chamber.

By using such an upper carboy, it is possible, after its filling, to perform the washing and blowing sequence with a drastically reduced total cycle time, the upper carboy being arranged as close as possible to the spray nozzles.

According to a particular feature of the invention, the pneumatic means comprises at least two upper carboys arranged in parallel, the control system being configured to control the upper carboy valves of the at least two upper carboys in parallel such that the at least two upper carboys each successively perform their washing and drying cycle.

Thus, this solution allows to do a series of washing cycles one after the other by filling the upper carboys in masking times when another upper carboy sends liquid towards the washing chamber in order to spray the part to be washed.

According to a first variant of the second embodiment of the invention, the liquid supply device is a water pump arranged between the liquid reservoir and the liquid inlet of the at least one upper carboy.

Thus, the conventional water pump allows to suck the liquid up from the liquid reservoir and push it back towards the at least one upper carboy of the pneumatic washing and drying machine.

According to a second variant of the second embodiment of the invention, the liquid supply device comprises at least one additional carboy arranged at the liquid reservoir, the at least one additional carboy comprising a liquid inlet connected to the liquid reservoir, a liquid outlet connected to the liquid inlet of the at least one upper carboy, an air inlet connected to an additional compressed air supply, and an air outlet connected to the air inlet of the at least one upper carboy, the liquid supply device further comprising additional carboy valves respectively connected to the inlets and outlets of the at least one additional carboy, the control system being configured to control said additional carboy valves so as to fill the at least one additional carboy with liquid from the liquid reservoir, inject compressed air into the at least one additional carboy so as to send, to the at least one upper carboy, the pressurized liquid contained into the at least one additional carboy, and then send the compressed air contained into the at least one additional carboy to the at least one upper carboy.

Thus, during a first phase, the additional carboy is filled with liquid from the liquid reservoir and, during a second phase, the liquid contained into the additional carboy is pushed towards the upper carboy by the compressed air injected into the additional carboy from the additional compressed air supply and, during a third phase, the compressed air used to push the liquid is sent towards the upper carboy, thereby allowing both to return the additional carboy at atmospheric pressure and blow the part to be washed arranged in the washing chamber simultaneously with the upper carboy blowing phase.

This solution thus allows to operate at higher pressures and temperatures compared to a case where a conventional pump is used.

According to a particular feature of the invention, a double boiler is arranged around the at least one upper carboy so as to overheat the liquid contained into the at least one upper carboy.

According to a particular feature of the invention, a filter is arranged within each carboy.

Thus, the filter allows to filtrate the impurities present in the washing liquid.

According to a particular feature of the invention, the pneumatic means further comprise, for each carboy, a recirculation and warming circuit configured to send the liquid and then the air from said carboy into the liquid reservoir.

Thus, the recirculation and warming circuit allows a recirculation and warming mode of the pneumatic washing and drying machine, in which the liquid and then the compressed air contained into the carboy are sent into the liquid reservoir, the liquid being pushed by the compressed air.

According to a particular feature of the invention, the spray nozzles are arranged on at least one stationary or rotating ramp arranged within the washing chamber.

Thus, the rotating ramp of spray nozzles allows to sprinkle and blow almost the entire surface of the part to be washed by rotating the rotating ramp around said part to be washed.

According to another variant, the ramp is stationary and the part is fixed on a rotating support carrying means allowing to make the part integral with the rotating support, thereby allowing the spray nozzles of the stationary ramp to sprinkle and blow almost the entire surface of the part to be washed by rotating the part to be washed below the stationary ramp.

According to another variant, the ramp can rotate and the part is fixed on a rotating support carrying means allowing to make the part integral with the rotating support, the rotating ramp and the rotating support can rotate in the same direction or in opposite directions, at the same speed or different speeds.

According to a last variant also contemplated in the scope of the present invention, the ramp is stationary and the part to be washed is stationary.

To better illustrate the object of the present invention, preferred embodiments will be described below for illustrative and non-limiting purposes, in reference to the appended drawings.

DETAILED DESCRIPTION OF THE PREFERRED EMBODIMENTS

Figure 1:
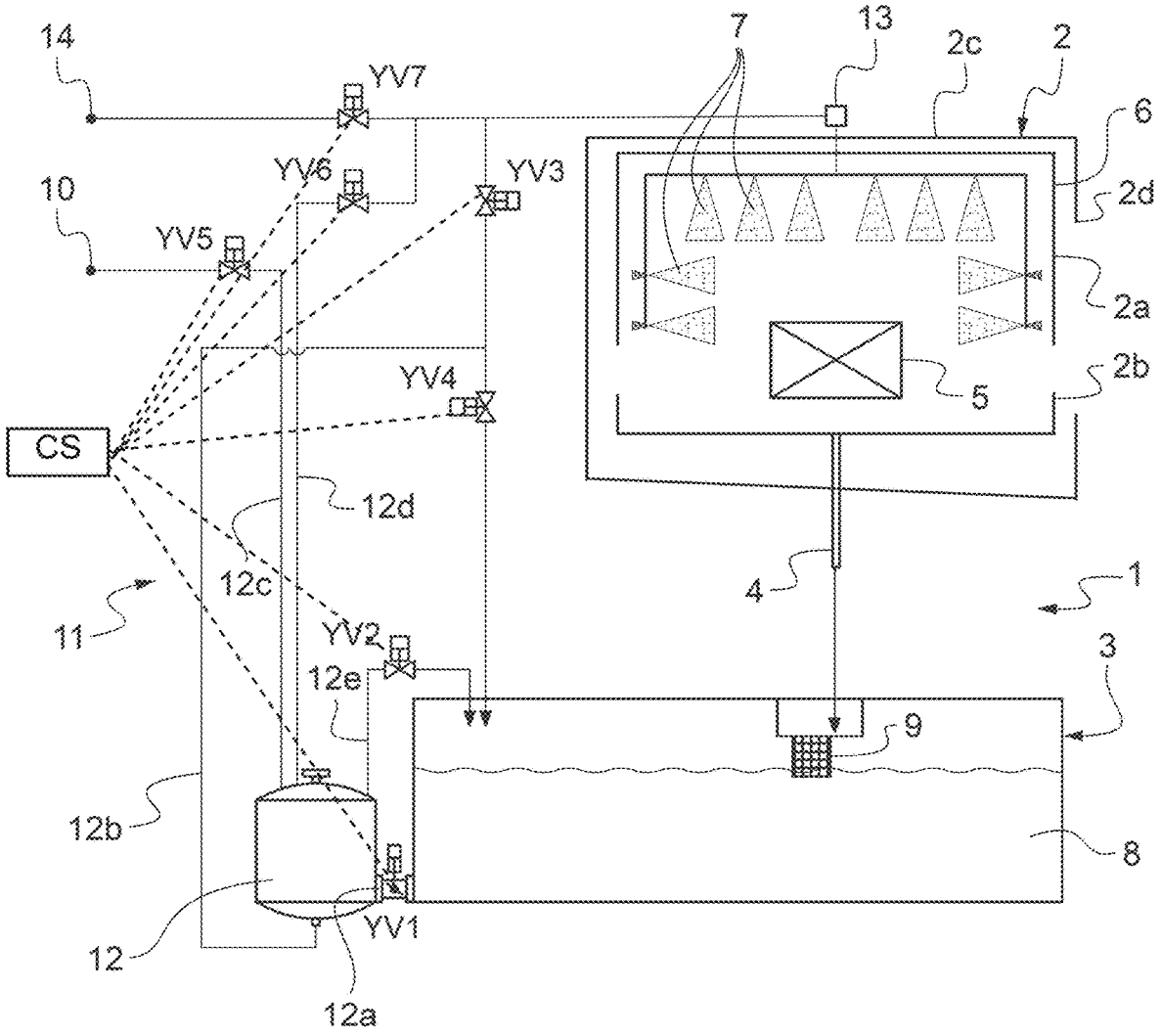
FIG. 1 is a schematic diagram of a pneumatic washing and drying machine according to a first variant of a first embodiment of the invention.

If referring to FIG. 1, a pneumatic washing and drying machine 1 according to a first variant of a first embodiment of the invention is shown.

The pneumatic washing and drying machine 1 comprises a washing chamber 2 and a liquid reservoir 3 in fluid communication with the washing chamber 2 so as to collect the fluid from the washing chamber 2, the liquid reservoir 3 being arranged below the washing chamber 2 such that the liquid flows from the washing chamber 2 to the liquid reservoir 3 by gravity via a waste pipe 4.

It can be noted that the liquid reservoir 3 could also be arranged near the washing chamber 2 while being at a height lower than the washing chamber 2, without departing from the scope of the present invention.

The washing chamber 2 comprises an upper portion 2*a* and a lower portion 2*b* on which a part to be washed 5 is arranged, the lower portion 2*b* being connected to the waste pipe, at least one from the upper 2*a* and lower 2*b* portions being movable such that the user can access the interior of the washing chamber 2.

The washing chamber 2 further comprises a housing 2*c* surrounding the upper 2*a* and lower 2*b* portions of the washing chamber 2 and comprising a lateral opening 2*d* such that the user can access the interior of the washing chamber 2, in particular to introduce therein a part to be washed 5.

The washing chamber 2 further comprises therein a rotating ramp 6 on which spray nozzles 7 are arranged, which are oriented towards the part to be washed 5 and configured to spray liquid so as to wash the part to be washed 5 and then air so as to blow the part to be washed 5 in order to dry the same.

The liquid reservoir 3 contains a washing liquid 8 therein, the washing liquid 8 being heated beforehand using at least one resistor (not shown in FIG. 1) disposed within the liquid reservoir 3.

A filter 9 is disposed within the liquid reservoir 3 at the inlet of the waste pipe 4, so as to filter the potential impurities present in the washing liquid from the washing chamber 2, thereby allowing to recycle the washing liquid, as described below.

The pneumatic washing and drying machine 1 further comprising a compressed air supply 10.

The pneumatic washing and drying machine 1 also comprises pneumatic means 11 powered by the compressed air supply 10 to bring liquid from the liquid reservoir 3 to the spray nozzles 7 via the air from the compressed air supply 10, and then to bring the air from the compressed air supply 10 to the spray nozzles 7, so as to perform a washing and drying cycle.

The pneumatic means 11 allow a recirculation of the liquid 8 contained into the liquid reservoir 3 towards the washing chamber 2, the washing liquid 8 preferably being water mixed with cleaning products such as detergents.

The pneumatic means 11 thus allow to wash the part to be washed 5 using the liquid 8 from the liquid reservoir 3, and then blow the part to be washed 5 using the compressed air used to push the liquid 8 towards the liquid 8 towards the washing chamber 2, thereby allowing to perform a washing and drying cycle in a minimum time and to operate at high liquid pressures and temperatures in the washing chamber.

The pneumatic means 11 has a lower carboy 12 arranged in line with the liquid reservoir 3 or below the same.

The lower carboy 12 comprises a liquid inlet 12*a* connected to the bottom of the liquid reservoir 3 via a valve YV1, a liquid outlet 12*b* connected to the spray nozzles 7 via a valve YV3 and a rotating joint 13 connected to the rotating ramp 6, an air inlet 12*c* connected to the compressed air supply 10 via a valve YV5, a first air outlet 12*d* connected to the spray nozzles 7 via a valve YV6 and the rotating joint 13, and a second air outlet 12*e* connected to the upper portion of the liquid reservoir 3 via a valve YV2.

The pneumatic means 11 further comprise a control system CS configured to control the valves YV1, YV2, YV3, YV5, YV6 and YV7 so as to fill the lower carboy 12 with liquid 8 from the liquid reservoir 3 by opening the valves YV1 and YV2, and inject compressed air from the compressed air supply 10 into the lower carboy 12 by opening the valve YV5 so as to send, to the spray nozzles 7, the pressurized liquid contained into the lower carboy 12 by opening the valve YV3, and then send the compressed air contained into the lower carboy 12 to the spray nozzles 7 by opening the valve YV6.

Thus, during a first filling phase, the lower carboy is filled with liquid 8 from the liquid reservoir 3 by communicating vessels and, during a second sprinkling phase, the liquid contained into the lower carboy 12 is pushed towards the spray nozzles 7 by the compressed air injected into the lower carboy 12 and, during a third depressurization and blowing phase, the compressed air used to push the liquid is sent towards the spray nozzles 7, thereby allowing to return the lower carboy 12 to atmospheric pressure and blow the part to be washed 5 arranged within the washing chamber 2.

The lower carboy 12 optionally comprises at least one liquid level sensor and one fluid pressure sensor.

The pneumatic washing and drying machine 1 further comprises an additional compressed air supply 14 connected to the spray nozzles 7 via a valve YV7, controlled by the control system, and the rotating joint 13. This additional compressed air supply 14 allows to perform a final blowing of the part to be washed 5 by opening the valve YV7, after the third depressurization and blowing phase.

The pneumatic means 11 further comprises a valve YV4 controlled by the control system and arranged between the liquid outlet 12*b* of the lower carboy 12 and the upper portion of the liquid reservoir 3. The valves YV2, YV4 and YV5 constitute a recirculation and warming circuit configured to send the liquid contained into the lower carboy 12 by opening the valves YV4 and YV5, and then the air contained into the lower carboy 12 by opening the valve YV2 within the liquid reservoir 3 so as to perform a recirculation and warming mode of the system, said liquid being pushed by said compressed air.

It can be noted that the lower carboy 12 could also comprise a filter therein, without departing from the scope of the present invention.

Figure 2:
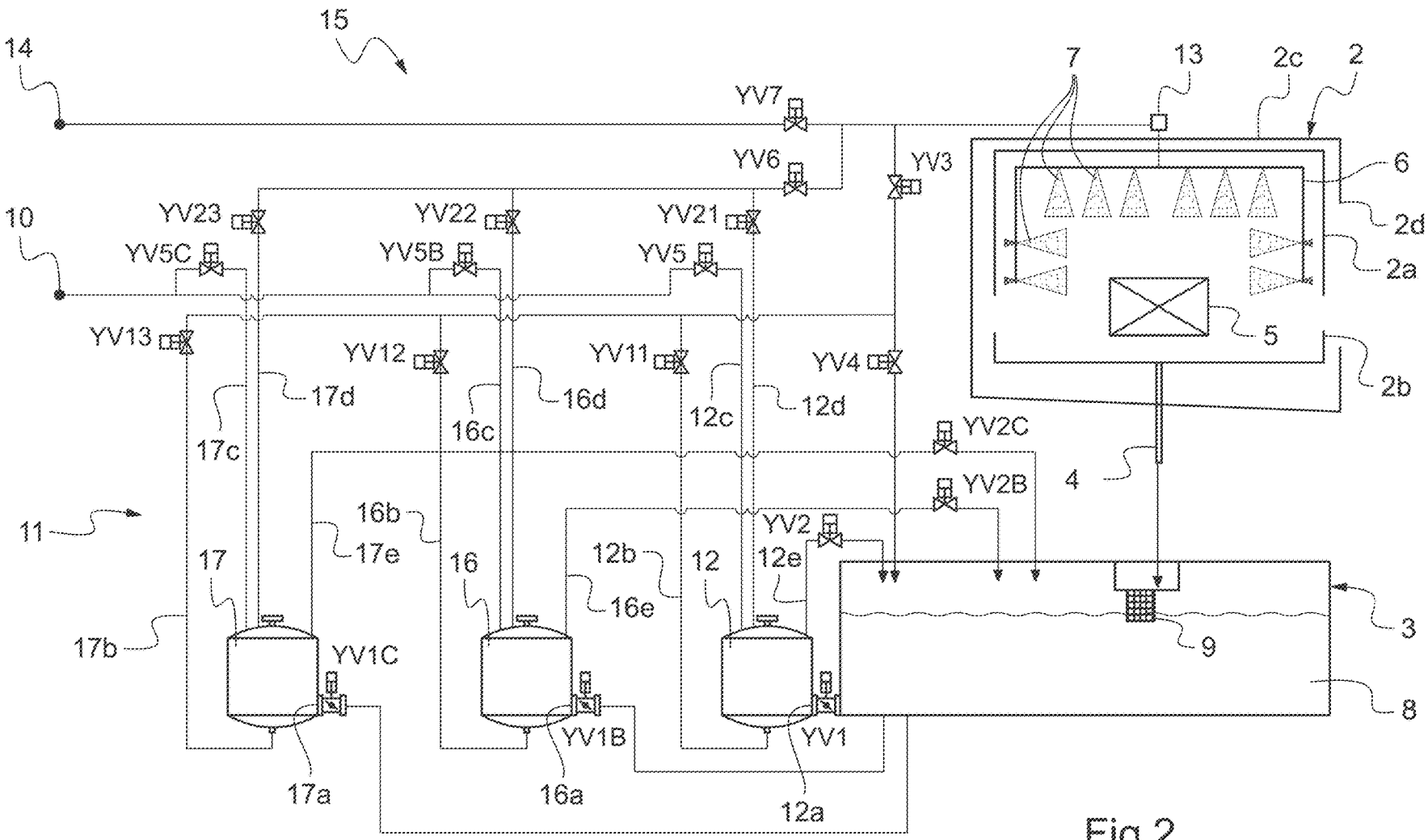
FIG. 2 is a schematic diagram of a pneumatic washing and drying machine according to a second variant of the first embodiment of the invention.

If referring to FIG. 2, a pneumatic washing and drying machine 15 according to a second variant of the first embodiment of the invention is shown.

The common elements between the first and second variants of the first embodiment of the invention have the same reference numeral, and will not be described in more detail when they have identical structures.

The pneumatic means 11 have three lower carboys 12, 16, 17 arranged in parallel.

It can be noted that the pneumatic means 11 could also comprise any number of lower carboys in parallel, without departing from the scope of the present invention.

The first lower carboy 12 according to the second variant is identical to that according to the first variant of the first embodiment of the invention, except that a valve YV11 is arranged between the liquid outlet 12*b* and the valve YV3 and that a valve YV21 is arranged between the first air outlet 12*d* and the valve YV6.

The second lower carboy 16 comprises a liquid inlet 16*a* connected to the bottom of the liquid reservoir 3 via a valve YV1B, a liquid outlet 16*b* connected to the valve YV3 via a valve YV12, an air inlet 16*c* connected to the compressed air supply 10 via a valve YV5B, a first air outlet 16*d* connected to the valve YV6 via a valve YV22, and a second air outlet 16*e* connected to the upper portion of the liquid reservoir 3 via a valve YV2B.

The third lower carboy 17 comprises a liquid inlet 17*a* connected to the bottom of the liquid reservoir 3 via a valve YV1C, a liquid outlet 17*b* connected to the valve YV3 via a valve YV13, an air inlet 17*c* connected to the compressed air supply 10 via a valve YV5C, a first air outlet 17*d* connected to the valve YV6 via a valve YV23, and a second air outlet 17*e* connected to the upper portion of the liquid reservoir 3 via a valve YV2C.

The valves YV11, YV12, YV13, YV21, YV22, YV23, YV5B, YV5C, YV1B, YV1C, YV2B and YV2C are controlled by the control system (not shown in FIG. 2).

The control system is configured to control all the valves, namely YV11, YV12, YV13, YV21, YV22 and YV23, of the three lower carboys 12, 16 and 17 such that the three lower carboys 12, 16 and 17 each successively perform their washing and drying cycle such as described in FIG. 1.

This second variant thus allows to multiply the sprinkling phases without waiting, the filling of the lower carboys being performed in masking times when another lower carboy sends liquid towards the washing chamber 2 so as to sprinkle the part to be washed 5.

Figure 3:
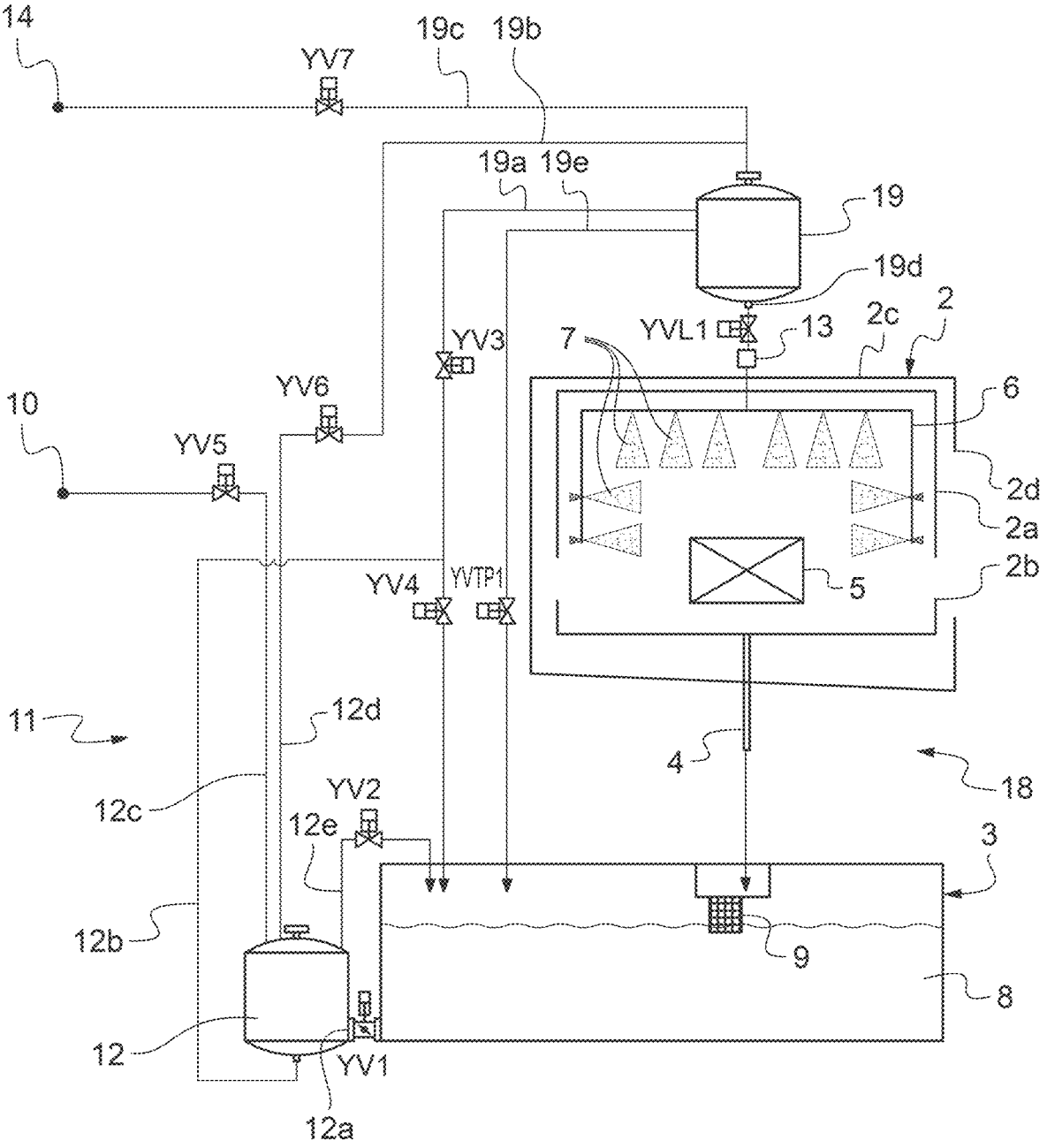
FIG. 3 is a schematic diagram of a pneumatic washing and drying machine according to a first variant of a second embodiment of the invention.

If referring to FIG. 3, a pneumatic washing and drying machine 18 according to a first variant of a second embodiment of the invention is shown.

The common elements between the first variant of the first embodiment of FIG. 1 and this first variant of the second embodiment have the same reference numeral, and will not be described in more detail when they have identical structures.

The pneumatic washing and drying machine 18 of FIG. 3 is identical to that of FIG. 1, except that the pneumatic means further comprise an upper carboy 19 arranged above the washing chamber 2.

The upper carboy 19 has a liquid inlet 19*a* connected to the valve YV3, a first air inlet 19*b* connected to the valve YV6, a second air inlet 19*c* connected to the valve YV7, a first fluid outlet 19*d* connected to the spray nozzles 7 via a valve YVL1, and a second fluid outlet 19*e* connected to the upper portion of the liquid reservoir 3 via a valve YVTP1.

The control system (not shown in FIG. 3) also controls the valves YVL1 and YVTP1.

The lower carboy 12 is used as a device for supplying liquid from the liquid reservoir 3 to the upper carboy 19 using the compressed air from the compressed air supply 10 according to the control of the valves described in FIG. 1.

Thus, the control system is configured to control the valves so as to fill the upper carboy 19 with liquid from the lower carboy 12, and then to inject compressed air from the additional compressed air supply 14 into the upper carboy 19 so as to send, to the spray nozzles 7, the pressurized liquid contained into the upper carboy 19, and send the compressed air contained into the upper carboy 19 to the spray nozzles 7.

By using such an upper carboy 19 arranged above the washing chamber 2, the control system can, after filling the upper carboy 19 with liquid, perform a washing and blowing sequence by opening only simultaneously the valves YV7 and YVL1, thereby greatly reducing the total cycle time.

The compressed air contained into the lower carboy 12 used to push the liquid towards the upper carboy 19 can be sent towards the upper carboy 19 by opening the valve YV6, or be sent towards the liquid reservoir 3 by opening the valve YV2.

The opening of the valve YVTP1 by the control system allows to discharge the air from the upper carboy 19 to the liquid reservoir 3.

It can be noted that a double boiler could also be arranged around the upper carboy 19 so as to overheat the liquid contained into the upper carboy 19, without departing from the scope of the present invention.

The upper carboy 19 could also have a filter therein, without departing from the scope of the present invention.

Figure 4:
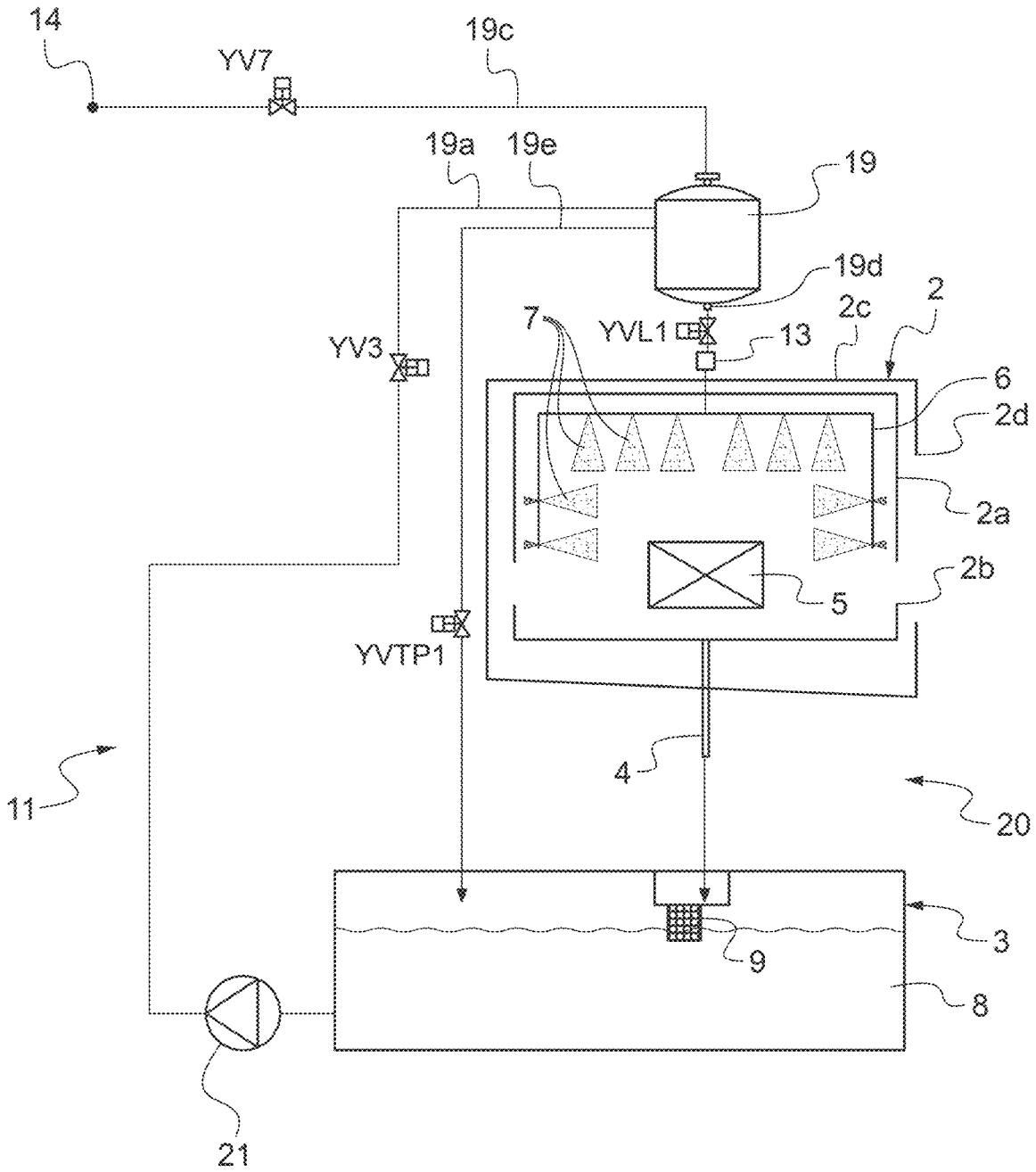
FIG. 4 is a schematic diagram of a pneumatic washing and drying machine according to a second variant of the second embodiment of the invention.

If referring to FIG. 4, a pneumatic washing and drying machine 20 according to a second variant of the second embodiment of the invention is shown.

The common elements between the first variant of the second embodiment of FIG. 3 and this second variant of the second embodiment have the same reference numeral, and will not be described in more detail when they have identical structures.

The pneumatic washing and drying machine 20 of FIG. 4 is identical to that of FIG. 3, except that the pneumatic means 11 have a water pump 21 as a liquid supply device and not a lower carboy supplied with compressed air, the water pump 21 being arranged between the liquid reservoir 3 and the liquid inlet 19*a* of the upper carboy 19 via the valve YV3, and except that the upper carboy 19 has only one air inlet 19*c* connected to the valve YV7.

The water pump 21 is a conventional pump allowing to suck the liquid 8 up from the liquid reservoir 3 and return the same to the upper carboy 19 of the pneumatic washing and drying machine 20, the water pump 21 being controlled by the control system.

The control of the valves YV3, YV7 and YVL1 by the control system is identical to that of the pneumatic washing and drying machine 18 of FIG. 3.

When filling the upper carboy 19 via the water pump 21, the valve YVTP1 is open so as to act as a vent.

The opening of the valves YV7 and YVL1 causes the blowing of the liquid then of the air to perform the washing and drying operations in the same action.

Figure 5:
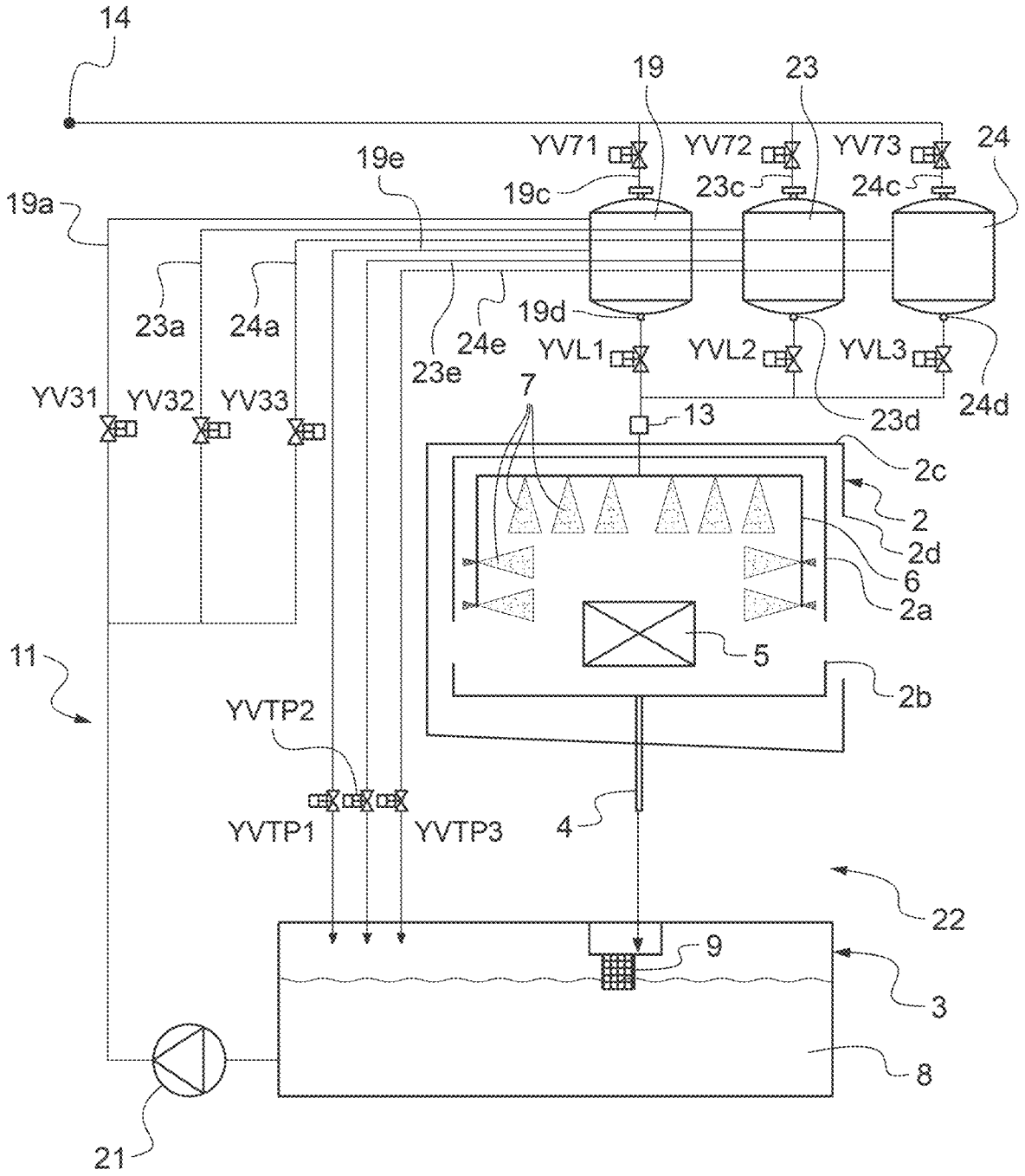
FIG. 5 is a schematic diagram of a pneumatic washing and drying machine according to a third variant of the second embodiment of the invention.

If referring to FIG. 5, a pneumatic washing and drying machine 22 according to a third variant of the second embodiment of the invention is shown.

The common elements between the second variant of the second embodiment of FIG. 4 and this third variant of the second embodiment have the same reference numeral, and will not be described in more detail when they have identical structures.

The pneumatic washing and drying machine 22 of FIG. 5 is identical to that of FIG. 4, except that the pneumatic means 11 has three upper carboys 19, 23 and 24 arranged in parallel.

It can be noted that the pneumatic means 11 could also have any number of upper carboys in parallel, without departing from the scope of the present invention.

The first upper carboy 19 comprises a liquid inlet 19*a* connected to the pump 21 via a valve YV31, a first fluid outlet 19*d* connected to the rotating joint 13 via a valve YVL1, a second fluid outlet 19*e* connected to the liquid reservoir 3 via a valve YVTP1, and an air inlet 19*c* connected to the compressed air supply 14 via a valve YV71.

The second upper carboy 23 comprises a liquid inlet 23*a* connected to the pump 21 via a valve YV32, a first fluid outlet 23*d* connected to the rotating joint 13 via a valve YVL2, a second fluid outlet 23*e* connected to the liquid reservoir 3 via a valve YVTP2, and an air inlet 23*c* connected to the compressed air supply 14 via a valve YV72.

The third upper carboy 24 comprises a liquid inlet 24*a* connected to the pump 21 via a valve YV33, a first fluid outlet 24*d* connected to the rotating joint 13 via a valve YVL3, a second fluid outlet 24*e* connected to the liquid reservoir 3 via a valve YVTP3, and an air inlet 24*c* connected to the compressed air supply 14 via a valve YV73.

The valves YV31, YV32, YV33, YV71, YV72, YV73, YVL1, YVL2, YVL3, YVTP1, YVTP2 and YVTP3 are controlled by the control system (not shown in FIG. 5).

The control system is configured to control the valves of the three upper carboys 19, 23 and 24 such that the three upper carboys 19, 23 and 24 each successively perform their washing and drying cycle such as described in FIG. 4.

This third variant for direct blowing allows to do a series of washing cycles one after the other by filling the upper carboys in masking times when another upper carboy sends fluid towards the washing chamber 2 so as to sprinkle and dry the part to be washed 5.

The control system can be any electronic circuit, namely a microprocessor, a microcontroller, a digital signal processor, a programmable gate array, an application specific integrated circuit, connected to the different control elements.

The invention claimed is:

1. A pneumatic washing and drying machine comprising:

a washing chamber;

a liquid reservoir in fluid communication with the washing chamber to collect a liquid from the washing chamber, the washing chamber internally comprising spray nozzles configured to spray the liquid within the washing chamber;

a compressed air supply; and a pneumatic system powered by the compressed air supply and comprising a controller configured to cause the liquid to be provided from the liquid reservoir to the spray nozzles via the air from the compressed air supply, and provide the air used to provide the liquid towards the washing chamber, to the spray nozzles, without using additional air from the compressed air supply, to perform at least one washing and drying cycle.

2. The pneumatic washing and drying machine according to claim 1, wherein the pneumatic system comprises at least one lower carboy disposed at the liquid reservoir, the at least one lower carboy comprising a liquid inlet connected to the liquid reservoir, a liquid outlet connected to the spray nozzles, an air inlet connected to the compressed air supply, and an air outlet connected to the spray nozzles, the pneumatic system further comprising lower carboy valves respectively connected to the inlets and outlets of the at least one lower carboy, the controller being configured to control the lower carboy valves to cause the at least one washing and drying cycle to occur in the washing chamber, the at least one washing and drying cycle comprising filling the at least one lower carboy with liquid from the liquid reservoir by gravity, injecting compressed air into the at least one lower carboy to send, to the spray nozzles, the pressurized liquid contained in the at least one lower carboy, and sending the compressed air contained in the at least one lower carboy to the spray nozzles.

3. The pneumatic washing and drying machine according to claim 2, wherein the at least one lower carboy comprises at least two lower carboys arranged in parallel, the controller being configured to control the lower carboy valves such that each of the at least two lower carboys successively causes the at least one washing and drying cycle to occur in the washing chamber.

4. The pneumatic washing and drying machine according to claim 2, further comprising an additional compressed air supply connected to the spray nozzles via an additional valve controlled by the controller.

5. The pneumatic washing and drying machine according to claim 1, wherein the pneumatic system comprises at least one upper carboy disposed above the washing chamber, the at least one upper carboy comprising a liquid inlet, an air inlet connected to the compressed air supply, and a fluid outlet connected to the spray nozzles, the pneumatic system further comprising upper carboy valves respectively connected to the inlets and the outlet of the at least one upper carboy and, a liquid supply device connected to the liquid inlet of the at least one upper carboy and to the liquid reservoir, the controller of the pneumatic system being configured to control the upper carboy valves to cause the at least one washing and drying cycle to occur in the washing chamber, the at least one washing and drying cycle comprising filling the at least one upper carboy with liquid from the liquid supply device, injecting compressed air into the at least one upper carboy to send, to the spray nozzles, the pressurized liquid contained in the at least one upper carboy, and sending the compressed air contained in the at least one upper carboy to the spray nozzles.

6. The pneumatic washing and drying machine according to claim 5, wherein the at least one upper carboy comprises at least two upper carboys disposed in parallel, the controller being configured to control the upper carboy valves such that each of the at least two upper carboys successively cause a washing and drying cycle to occur.

7. The pneumatic washing and drying machine according to claim 5, wherein the liquid supply device is a water pump disposed between the liquid reservoir and the liquid inlet of the at least one upper carboy.

8. The pneumatic washing and drying machine according to claim 5, wherein the liquid supply device comprises at least one additional carboy disposed at the liquid reservoir, the at least one additional carboy comprising a liquid inlet connected to the liquid reservoir, a liquid outlet connected to the liquid inlet of the at least one upper carboy, an air inlet connected to an additional compressed air supply, and an air outlet connected to the air inlet of the at least one upper carboy, additional carboy valves respectively connected to the inlets and outlets of the at least one additional carboy, the controller being configured to control the additional carboy valves to fill the at least one additional carboy with liquid from the liquid reservoir, to inject compressed air into the at least one additional carboy to send, to the at least one upper carboy, the pressurized liquid contained in the at least one additional carboy, and to send the compressed air contained in the at least one additional carboy to the at least one upper carboy.

9. The pneumatic washing and drying machine according to claim 5, further comprising a double boiler disposed around the at least one upper carboy to overheat the liquid contained in the at least one upper carboy.

10. The pneumatic washing and drying machine according to claim 2, further comprising a filter disposed within each one of the at least one lower carboy.

11. The pneumatic washing and drying machine according to claim 2, wherein the pneumatic system further comprises a recirculation and warming circuit configured to send the liquid and the air from the at least one lower carboy into the liquid reservoir.

12. The pneumatic washing and drying machine according to claim 2, wherein the spray nozzles are disposed on at least one stationary or rotating ramp arranged within the washing chamber.

* * * * *